US009637288B2

(12) United States Patent
Abegglen et al.

(10) Patent No.: US 9,637,288 B2
(45) Date of Patent: May 2, 2017

(54) SEALABLE ELEMENT FOR SEALING A RIM OF RECEPTACLES

(71) Applicant: NESTEC S.A., Vevey (CH)

(72) Inventors: Daniel Abegglen, Rances (CH); Berenice Connes, Yverdon-les-Bains (CH); Gilles Demaurex, Carlisle Cumbria (GB); Philippe Domansky, Mollens (CH); Thierry Fabozzi, Geneva (CH); Stephane Hentzel, Yvonand (CH); XiaoFeng Lan, Pully (CH); Raphael Thivolet, Beijing (CN)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/367,485

(22) PCT Filed: Dec. 17, 2012

(86) PCT No.: PCT/EP2012/075752
§ 371 (c)(1),
(2) Date: Jun. 20, 2014

(87) PCT Pub. No.: WO2013/092472
PCT Pub. Date: Jun. 27, 2013

(65) Prior Publication Data

US 2014/0312039 A1 Oct. 23, 2014

(30) Foreign Application Priority Data

Dec. 21, 2011 (EP) ..... 11195020

(51) Int. Cl.
*B65D 53/04* (2006.01)
*B65D 51/22* (2006.01)
*B65D 51/20* (2006.01)

(52) U.S. Cl.
CPC ..... *B65D 51/228* (2013.01); *B65D 51/20* (2013.01); *B65D 53/04* (2013.01);
(Continued)

(58) Field of Classification Search
CPC ..... B65D 51/228; B65D 53/04; B65D 51/20; B65D 2577/2058; B65D 2577/205; B65D 2251/0093; B65D 2251/0015
(Continued)

(56) References Cited

U.S. PATENT DOCUMENTS 4,722,447 A 2/1988 Crisci
5,915,577 A * 6/1999 Levine ..... B65D 41/045 215/232

(Continued)

FOREIGN PATENT DOCUMENTS

| | | |
|---|---|---|
| EP | 0694345 | 1/1996 |
| EP | 2000062 | 12/2008 |
| JP | 01144357 | 10/1989 |

OTHER PUBLICATIONS

Japanese Patent Office Action for Application No. P2014-547886, Dispatch No. 597118, Dispatch Date Jan. 4, 2017, 7 pages.

*Primary Examiner* — James N Smalley
(74) *Attorney, Agent, or Firm* — K&L Gates LLP

(57) ABSTRACT

The present invention relates to a sealable element (1) for sealing the rim (21) of receptacles (20), the element (1) comprising at least a backing layer (2) made from a deformable material, and a sealable membrane (3) detachably connected to the backing layer (2), wherein the membrane (3) comprises an additional or integral opening means (4), wherein at least the membrane (3) has a contour with a radius varying between a lower radius value (L) and an upper radius value (U), wherein the ratio between the lower radius value (L) and the upper radius value (U) is defined by the equation $0.9 \leq L/u \leq 0.99$, preferably $0.95 \leq L/u \leq 0.97$. The
(Continued)

invention further relates to a cap (10) comprising said sealable element (1) and to a receptacle (20) comprising said cap (10) being removably attached onto an opening (O).

13 Claims, 6 Drawing Sheets

(52) U.S. Cl.
CPC ..... *B65D 2251/0015* (2013.01); *B65D 2251/0093* (2013.01); *B65D 2577/205* (2013.01); *B65D 2577/2058* (2013.01)

(58) Field of Classification Search
USPC ..... 215/232; 220/359.1–359.4, 258.1, 258.2
See application file for complete search history.

(56) References Cited

U.S. PATENT DOCUMENTS

| | | | | |
|---|---|---|---|---|
| 6,277,478 | B1 * | 8/2001 | Kurita | B29C 65/3656 215/232 |
| 6,425,492 | B1 * | 7/2002 | Ekkert | B65D 41/045 215/350 |
| 7,780,024 | B1 | 8/2010 | Marsella et al. | |
| 2009/0078671 | A1 * | 3/2009 | Triquet | B65D 53/04 215/232 |
| 2012/0103988 | A1 | 5/2012 | Wiening | |

* cited by examiner

SEALABLE ELEMENT FOR SEALING A RIM OF RECEPTACLES

CROSS REFERENCE TO RELATED APPLICATIONS

The present application is a National Stage of International Application No. PCT/EP2012/075752, filed on Dec. 17, 2012, which claims priority to European Patent Application No. 11195020.0, filed Dec. 21, 2011, the entire contents of which are being incorporated herein by reference.

FIELD OF THE INVENTION

The invention relates to a sealable, preferably heat-sealable element for sealing the rim of receptacles such as e.g. glass jars, a cap comprising said sealable element for closing said receptacle, and a receptacle comprising said cap having the sealable element.

BACKGROUND OF THE INVENTION

It is well known to seal containers or receptacles like glass jars, e.g. for containing (dried and/or powdered) nutritional components such as coffee or spread, with a screwable or clippable plastic cap. In general, the opening of the receptacle is sealably closed by a membrane to hermetically seal the container before the initial opening. Further, a backing layer or support is provided inside the cap to absorb the tolerances between the bottom of the cap and the upper rim of the container. It is thus possible to achieve a certain sealing effect from the ambiance, especially against humidity, when the container is reclosed with the cap after the membrane has been opened/removed from the container. This comes about since the backing layer is pressed against the upper rim of the container.

A heat-sealable sealing element for closing a container having a cap closure is, for instance, known from EP 2 045 194 B1. The heat-sealable sealing element consists of a heat-sealable membrane placed on the whole periphery of the upper rim of the neck of the container or mouth, thereby isolating the container from the exterior, and on the other hand, of a generally thicker support or backing layer, inserted in the bottom of the cap. Prior to the initial opening of the container, particularly before inserting the sealing element in the cap, the support and the heat-sealable membrane are joined by means of a temporary adhesive. The relatively thick and stiff heat-sealable membrane is opened by the consumer not by punching or tearing, but rather by peeling it off from the upper rim of the container using a tab.

In practice, the sealing element is inserted at the bottom of the cap and retained therein via a retention bead of the cap. Once the container is filled, the cap provided with the sealing element is screwed or clipped to the container. The heat-sealable membrane of the sealing element is then in contact with the mouth. The heat-sealable membrane is then sealed to the mouth by induction heat-sealing. Upon opening the container for the first time, the support inserted at the bottom of the plug is detached from the heat-sealable membrane which remains sealed on the upper rim of the container. A temporary adhesive provided between the heat-sealable membrane and the support will be broken preferably by shearing as a result of the separation of the heat-sealable membrane sealed on the container and the support retained in the cap via the retention bead. As the heat-sealable membrane is made from a stiff material a relatively great opening torque (particularly when the cap is screwed to the container) or opening force (particularly when the cap is clipped to the container) is required when the user opens the container for the first time. This great opening torque or force is caused by the fact that at the time of the initial opening the relatively thick heat-sealable membrane has to pass the retention bead.

SUMMARY OF THE INVENTION

The present invention aims to improve on the above-mentioned drawbacks, and an object thereof is to provide a sealable element for sealing the rim of a receptacle which allows an easy and comfortable initial opening of the receptacle.

The object is to be accomplished by means of the independent claims. The dependent claims advantageously study further the central idea of the invention.

According to a first aspect of the invention, there is provided a sealable, preferably heat-sealable element for sealing the rim of receptacles such as e.g. glass jars. The element comprises at least a backing layer made from a deformable material, and a sealable, preferably heat-sealable membrane (in the following also referred to as "membrane") having a substantially circular form or shape and being detachably connected to the backing layer. The membrane comprises an additional or integral opening means such as an opening tab or an opening lid. At least the membrane has a contour with a radius varying between a lower radius value L and an upper radius value U, wherein the ratio between the lower radius value L and the upper radius value U is defined by the equation:

$$0.9 \leq L/U \leq 0.99,$$

preferably $0.95 \leq L/U \leq 0.97$.

The invention thus provides a sealable element by means of which an undesired high opening torque or force can be reduced in that an overhanging surface area of the membrane required for initially retaining the membrane in the cap via the retention portion is reduced. It has been found that a reduction by 50% of the overhanging area of the membrane which interacts or is engaged with the retention portion leads to a reduction of the opening torque or force of the initial opening of the cap of approximately 25%. Hence, while the shape and dimensions of the sealable element or at least of the membrane lead to a reduction of the opening torque or force, the sealable element or membrane is still designed such that it can be securely retained in the cap via the retention portion. It is thus possible, to provide a sealable element which can be securely retained in a cap during the mounting of the cap on a receptacle and the sealing of the membrane to the upper rim of the container or receptacle, while an initial opening of the cap is made more comfortable for the user without a degradation in the sealing effect of the cap.

The membrane can have a corrugated or undulated or segmented or stepped or serrated (or another kind of contoured) outer circumference or contour, such that the contour of the membrane alternately changes between the lower radius value and the upper radius value, wherein the contour of the membrane preferably has a radius continuously or stepwise or partially continuously and partially stepwise varying between the lower radius value and the upper radius value. The invention is thus not limited to any particular contour of the membrane as long as it comprises lower and upper radius values. Preferably, the upper radius value portions of the membrane extend over less than 75% of the total outer circumference of the sealable element or better the membrane, preferably less than 50%, more preferably less than 25%. It is noted that the upper and lower radius value portions do not need to extend over the outer circumference at a stretch but the upper and lower radius value portions are preferably alternately provided about and preferably evenly distributed over the circumference of at least the membrane.

It has been mentioned that the sealable element comprises an opening means of the membrane. The opening means can be an additional or an integral part of the membrane. In the latter case, the opening means preferably is part of the membrane structure as described herein. The opening means can be an opening tab connected to the rim portion of the membrane and preferably being positioned between the backing layer and the membrane, wherein the opening tab is preferably arranged in an area in which the contour of the membrane presents the upper radius value. The opening means can also be an opening lid connected to the membrane and having a tab (i.e. an opening tab) as described above. This also encompasses an embodiment where the only overhanging portion, i.e. upper value radius portion is actually the connecting portion to the opening tab. In any case, the opening tab or lid allows an easy opening of the receptacle as the membrane sealed on the rim of the receptacle can be easily removed by pulling at the opening tab. The membrane will then easily be rolled off the upper rim and will, for instance, not break in a slot-like opening. It is noted that also at least one upper radius value portion of the membrane defining an "overhanging portion", i.e. a portion which radially extends beyond the outer circumference of the upper rim of the receptacle, can be used (and thus be considered) as an opening means of the membrane. For opening the receptacle, the user can then pull at the upper radius value portion to roll the membrane off the upper rim.

Preferably, the backing layer and the membrane are detachably connected to each other mechanically or by means of a temporary assembly layer or temporary adhesive. The temporary assembly layer or adhesive is preferably provided/applied between the backing layer and the membrane which are thus temporarily "glued" together. The mechanical or adhesive force should be dimensioned such that the backing layer and membrane can be detached once the cap is removed from the receptacle for the first time.

In a preferred embodiment, the backing layer has substantially the same outer contour as the membrane. It is thus possible to contour the membrane while already being detachably connected to the backing layer material. Hence, the sealable element can be simply produced and handled.

The backing layer is preferably made from foaming materials like expanded plastics such as polyethylene (EPE) or polypropylene (EPP), or is made from cardboard. Preferably, the backing layer is made up of two high-density polyethylene (HDPE) layers sandwiching an expanded polyethylene (EPE) layer.

The membrane may comprise a diffusion barrier layer preferably made of or comprising aluminum. In a preferred embodiment, the membrane is made up of a stiff material compound, comprising a heat-sealable layer preferably made of polyethylene (PE), polypropylene (PP) or polyester, a diffusion barrier layer preferably made of aluminum, and a reinforcing layer preferably made of plastics, preferably polyester like polyethylene terephthalate (PET).

According to a second aspect of the invention, there is provided a sealable element for sealing the rim of receptacles such as e.g. glass jars. The element comprises at least a backing layer made from a deformable material, a sealable, preferably heat-sealable membrane being detachably connected to the backing layer, and an opening tab connected to the rim portion of the membrane and being positioned between the backing layer and the membrane. At least the membrane has a contour with a radius varying between a lower radius value L and an upper radius value U. The opening tab is arranged in an area in which the contour of the membrane presents the upper radius value U.

The invention thus provides a sealable element by means of which an undesired high opening torque or force can be reduced in that an overhanging (surface) area of the membrane required for initially retaining the membrane in the cap by an engagement with the retention portion is reduced. While the shape and dimensions of the sealable element or at least of the membrane lead to a reduction of the opening torque, the sealable element or membrane is still designed such that it can be securely retained in the cap via the retention portion. It is thus possible, to provide a sealable element which can be securely retained in a cap during the mounting of the cap on a receptacle and the sealing of the membrane to the upper rim of the container while an initial opening of the cap is made more comfortable for the user by pulling at the upper radius value portion or opening tab without a degradation in the sealing effect of the cap.

According to a third aspect of the invention, there is provided a cap for closing a receptacle such as e.g. a glass jar. The cap comprises a cap base body with a fixing means like a screw thread (in the following also referred to as "thread") or a clipping means (e.g. a circumferential ring) or the like for enabling the cap to be removably attached (e.g. screwed or clipped or the like) on the receptacle, and a sealable element according to the invention which is retained inside the cap via a retention portion of the cap base body. It has already been described above that the inventive sealable element can be used in such a cap with the aim of reducing the opening torque of the cap when initially opening a receptacle closed with said cap.

The retention portion preferably radially extends from an inner side wall of the cap base body of the cap. The retention portion thus preferably forms a retention bead, preferably a ring-shaped or circumferential retention bead preferably having a circular form.

Preferably, a maximum radius of the membrane in an area in which the contour of the membrane presents the lower radius value is identical to or smaller than the radius of the inner circumferential edge of the retention portion, and a maximum radius of the membrane in an area in which the contour of the membrane presents the upper radius value is greater than the radius of the inner circumferential edge of the retention portion. Hence, the area of the membrane being engaged by the retention portion can be reduced thus effectively leading to a reduced opening torque of the cap.

According to a fourth aspect of the invention, there is provided a receptacle such as e.g. a glass jar for containing (dried and/or powdered) nutritional products. The receptacle comprises a cap according to the invention. The cap is removably attached onto an opening of the receptacle via its fixing means (e.g. thread or clipping means or the like) being engaged with a correspondent fixing means (e.g. thread or clipping means or the like) of the receptacle provided at its outer side wall such that the membrane rests on and is sealed to an upper rim of the receptacle enclosing its opening, wherein the membrane is pressed towards the upper rim by means of the backing layer. Preferably, at least an area of the membrane in which the contour of the membrane presents the upper radius value and preferably also an area of the membrane in which the contour of the membrane presents the lower radius value L radially extends beyond the outer circumference of the upper rim of the receptacle.

Further features, advantages and objects of the present invention would come apparent for the skilled person when reading the following detailed description of embodiments of the present invention, when taking in conjunction with the figures of the enclosed drawings.

DETAILED DESCRIPTION OF THE INVENTION

Figure 1:
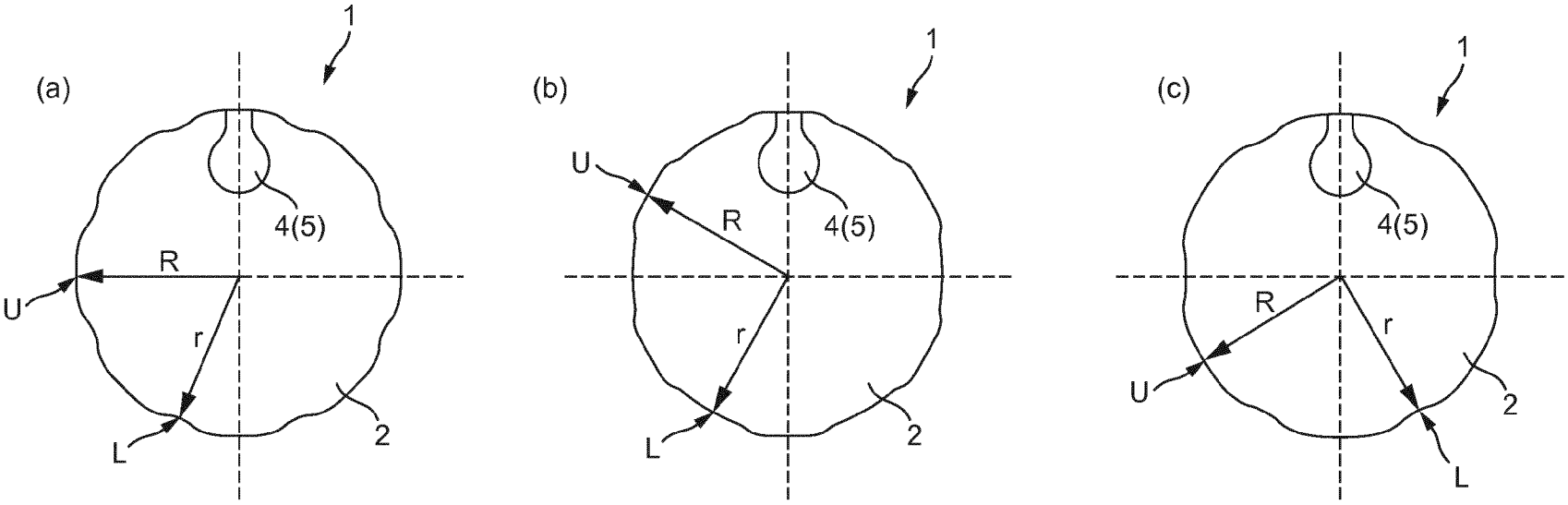
FIG. 1 shows a top view of three embodiments of the sealable element or membrane according to the invention.

FIG. 1 shows different embodiments of a sealable, preferably heat-sealable element 1 or at least of a (sealable, preferably heat-sealable) membrane 3 of said sealable element 1 according to the invention. The sealable element 1 is intended to be used for sealing a rim 21 (bordering the opening O) of receptacles or containers 20 (see FIGS. 3 to 6). Examples for such containers are glass jars which may be filled with (dried and/or powdered) nutritional products like coffee (beans or powder) or spread or the like. The sealable element 1 (in the following also referred to as "element") comprises at least a backing layer 2 and the sealable, preferably heat-sealable membrane 3 (in the following also referred to as "membrane") (see FIGS. 2 to 4), the preferred structure of which will be described herein with respect to FIG. 2.

The membrane 3 is intended to hermetically seal the receptacle 20 such that the product remains fresh over a long time, e.g. during transport and storage. Therefore, the membrane 3 preferably comprises a diffusion barrier layer 301 preferably made of or at least comprising aluminum. The membrane 3 can be removed from the rim of the receptacle 20 by a user to allow access to the product.

The backing layer 2 is intended to absorb the tolerances between a bottom 11 of a cap 10 and the upper rim 21 of the receptacle 20. Once the receptacle 20 has been opened and the membrane 3 has been removed from the receptacle 20, a certain sealing effect from the ambiance, especially against humidity, is achieved by the backing layer 2 when reclosing the receptacle 20 with the cap 10. Therefore, the backing layer 2 is made from a deformable material 200, preferably from foaming materials like expanded plastics such as polyethylene (EPE) or polypropylene (EPP), or it is made from cardboard or the like. Preferably, the backing layer 2 is glued or otherwise fixedly connected or adhered to the bottom 11 of the cap 10.

The thickness of the backing layer 2 is larger than, preferably more than twice the thickness of the membrane 3.

Figure 2:
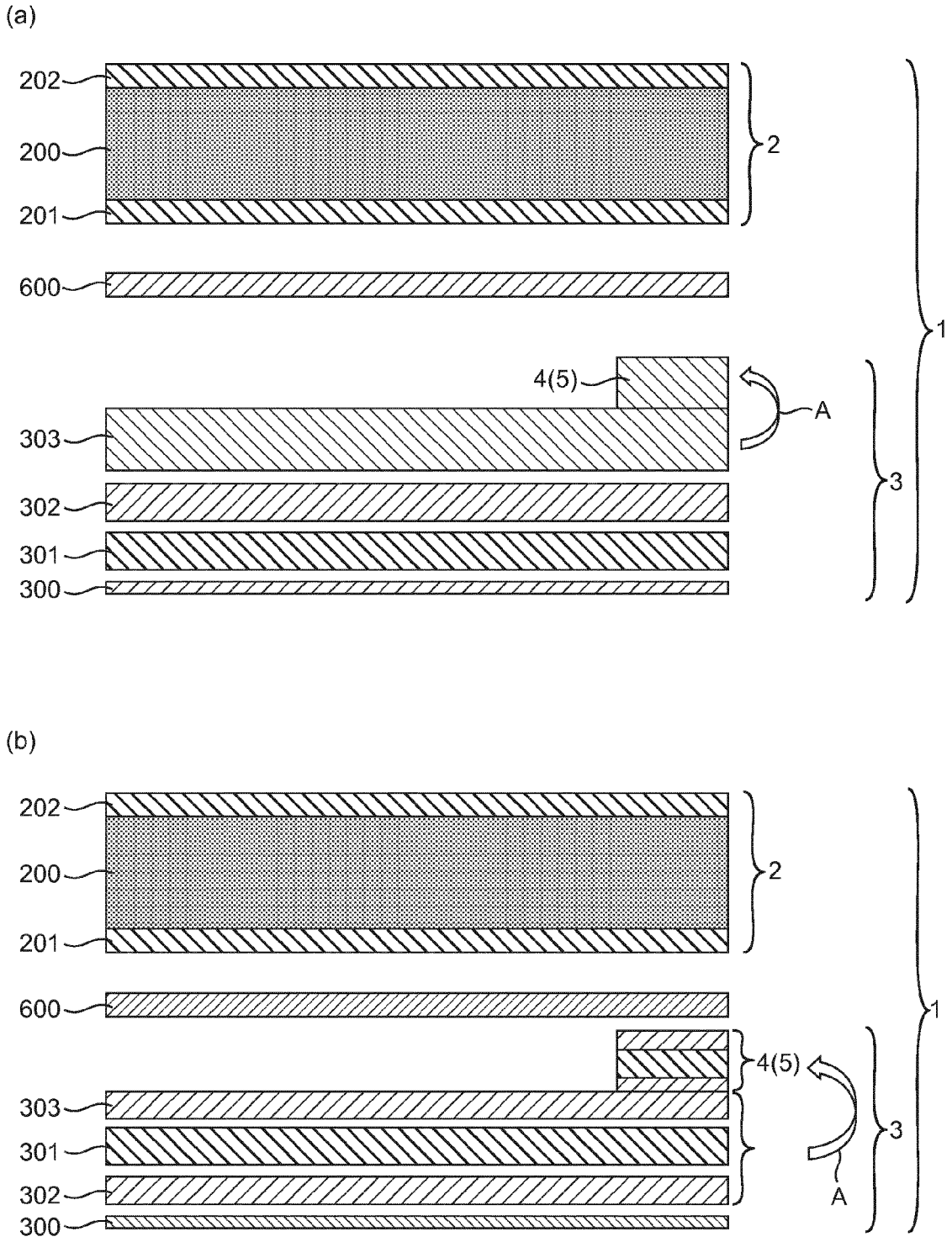
FIG. 2 shows a schematic view of two embodiments of the layered structure of the sealable element according to the invention.

FIG. 2 shows two preferred embodiments of the (layered) structure of the element 1. The backing layer 2 in both FIGS. 2*a* and 2*b* comprises the above-mentioned deformable, preferably resilient material 200 preferably made of an expanded plastic or cardboard which is optionally provided on at least one of its two faces with a (comparably thin) layer 201, 202 (e.g. made of polypropylene (PP), polyethylene (PE) or polyester like high-density polyethylene (HDPE)) to impart some stiffness.

The membrane 3 can be made up of a more (FIG. 2*a*) or less (FIG. 2*b*) stiff material compound. With respect to FIG. 2*a*, the membrane 3 comprises a heat-sealable layer 300 preferably made of polyethylene (PE), polypropylene (PP) or polyester. By means of said heat-sealable layer 300, the membrane 3 can be sealed onto the rim 21 of the receptacle 20 as will be described herein. Further, the membrane 3 according to FIG. 2*a* comprises a diffusion barrier layer 301 preferably made of aluminum. The heat-sealable layer 300 and the diffusion barrier layer 301 can be joined by means of a binder, or the diffusion barrier layer 301 is coated with the heat-sealable layer 300. Moreover, the membrane 3 may comprise at least one reinforcing layer 302, 303 which is preferably made of plastics, preferably polyester like polyethylene terephthalate (PET). In FIG. 2*a*, two reinforcing layers 302, 303 are superposed and joined to the diffusion barrier layer 301, preferably by means of a binder or by coating. In particular, a first reinforcing layer 302 is joined to the diffusion barrier layer 301 on a face thereof being opposite to the heat-sealable layer 300, while a second reinforcing layer 303 is joined to the first reinforcing layer 302 on a face thereof being opposite to the diffusion barrier layer 301 and the heat-sealable layer 300. In a preferred embodiment, the second reinforcing layer 303 being exposed to an outside (i.e. most distanced from the heat-sealable layer 300) can be printed to provide the membrane 3 with a brand name or a membrane opening instruction for the consumer or the like.

With respect to FIG. 2*b*, the membrane 3 is made of a less stiff material in comparison with the embodiment of FIG. 2*a*. In the embodiment of FIG. 2*b*, the heat-sealable layer 300 is joined to the first reinforcing layer 302. The diffusion barrier layer 301 is joined to the first reinforcing layer 302 on a face thereof being opposite to the heat-sealable layer 300. The second reinforcing layer 303 is joined to the diffusion barrier layer 301 on a face thereof being opposite to the first reinforcing layer 302 and the heat-sealable layer 300. The second reinforcing layer 303 can be printed.

It is noted that the element 1, particularly the backing layer 2 and the membrane 3, is/are neither limited to the materials nor to the order of the layers as depicted in the enclosed embodiments of FIG. 2.

The membrane 3 is detachably connected to the backing layer 2. Therefore, the backing layer 2 and the membrane 3 can be mechanically connected, e.g. they can be structured such that these structures engage with each other for temporarily connecting the membrane 3 and the backing layer 2. It is also possible that a temporary assembly layer or temporary adhesive 600 is applied between the backing layer 2 and the membrane 3 as shown in FIG. 2 which are thus temporarily "glued" together. The temporary layer or adhesive 600 can be applied in places at a plurality of points, for example microcrystalline wax or, by means of an extruded film consisting for example of a polymer such as polyethylene (PE). The temporary assembly layer or adhesive 600 may also be a co-extruded film. Such films can be designed such that each of the two faces thereof has a different adhesive power. The more adhesive face can then be applied to the membrane 3 while the less adhesive face is applied to the backing layer 2 of the membrane 3 so that the temporary adhesive layer 600 can be removed with the membrane 3 once the receptacle 20 is opened. The adhesive force should be dimensioned such that the backing layer 2 and membrane 3 remain connected during assembly of the sealable element 1 into the cap 10 and are easily detached once the cap 10 is initially removed from the receptacle 20.

FIGS. 3 and 4 each show two embodiments of such a cap 10 being provided on or better removably attached onto the receptacle 20 before an initial opening thereof. In FIGS. 3 and 4, the cap 10 comprises a cap base body 12 which is preferably made of plastics. The cap base body 12 can be integrally formed as a single piece member, or it can comprise a plurality of members being assembled to form the cap 10. In the latter case and as shown in FIGS. 3 and 4, the cap base body 12 may comprise an inner body 17 comprising a fixing means 13 like a screw thread (see FIGS. 3 to 6) or clips (not shown) or the like on its inner side wall 14 (identical with the inner side wall of the cap 10) for screwing/clipping/fixing the cap 10 onto the receptacle 20. Said inner body 17 can be inserted in and held by an outer (aesthetic) body 18 via a retention structure 19.

The fixing means 13 (e.g. screw thread or clipping means) on the inner side wall 14 of the single-part or multi-part cap 10 is intended to engage with a correspondent fixing means 22 like a screw thread (see FIGS. 3 to 6) or a clipping means (not shown) or the like of the receptacle 20 being provided at its outer side wall 23 close to the upper rim 21 bordering the opening O for removably attaching the cap 10 on the receptacle 20.

As can be clearly seen, the cap 10 comprises the sealable element 1 according to the invention which is retained inside the cap 10 via a retention portion 15. The retention portion 15 is preferably integrally formed with the cap 10 or better cap base body 12. The retention portion 15 preferably radially extends from the inner side wall 14 of the cap 10 and thus forms a retention bead. In a preferred embodiment, the retention bead 15 extends over the whole circumference of the inner side wall 14 of the cap 10 thus forming a ring-shaped or circumferential retention bead. Before the initial opening of the receptacle 20, both the backing layer 2 and the membrane 3 are retained inside the cap 10 by the retention portion 15, i.e. their circumferential area or better overhanging portion is at least partially placed between the retention portion 15 and the bottom 11 of the cap 10.

The cap 10 comprising the sealable element 1 is removably attached onto the opening O of the receptacle 20 such that the membrane 3 rests on the upper rim 21 of the receptacle 20 enclosing its opening O. In this position, the membrane 3 is pressed towards the upper rim 21 by means of the backing layer 2 which in turn is supported by the bottom 11 of the cap 10. By means of induction heat-sealing or welding, the membrane 3 can then be sealed onto the upper rim 21 of the receptacle 20 filled with nutritional products to thus provide a hermetical seal for said product. Alternatively, it is also possible that the membrane 3 is provided with an adhesive (e.g. glue or the like) on a face opposite to the backing layer 2; i.e. a face intended to be attached to the upper rim 21 of the receptacle 20. The adhesive is applied onto the membrane 3 such that its adhesive covered area corresponds to the upper rim 21 surface of the receptacle; i.e. the surface area of the membrane 3 intended to be in contact with the upper rim 21 of the receptacle 20 once the cap 10 is attached to the receptacle 20 is covered with the adhesive for sealably attaching the membrane 3 onto the upper rim 21 of the receptacle 20 thus hermetically sealing the receptacle 20. With respect to the structure of the membrane 3 as shown in FIG. 2, the adhesive can either be applied onto the heat-sealable layer 300 or the heat-sealable layer 300 can be omitted and the adhesive is applied onto the diffusion barrier layer 301 (FIG. 2*a*) or the first reinforcing layer 302 (FIG. 2*b*) or any other layer facing the upper rim 21 of the receptacle 20.

Figure 5A:
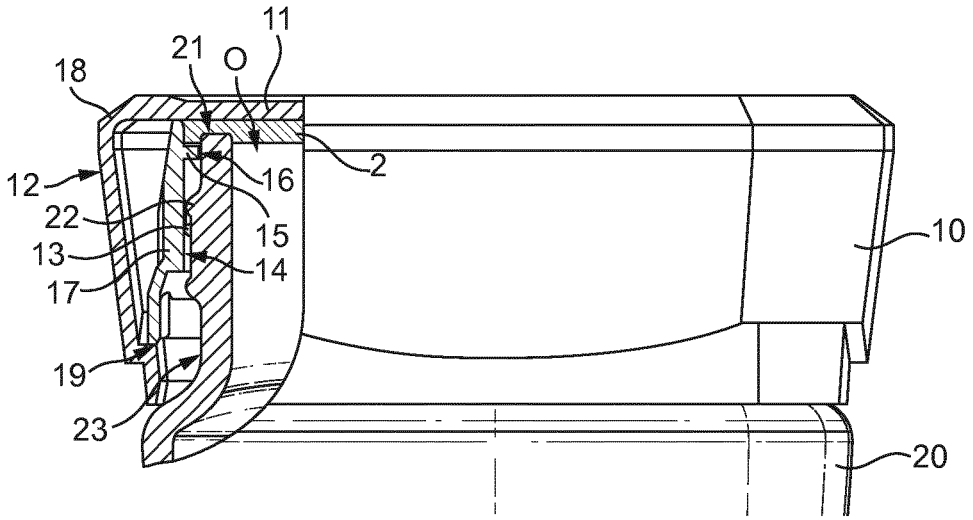
FIG. 5 shows the receptacles as shown in FIG. 3 after the membrane has been removed from the rim of the receptacle.
Figure 5B:
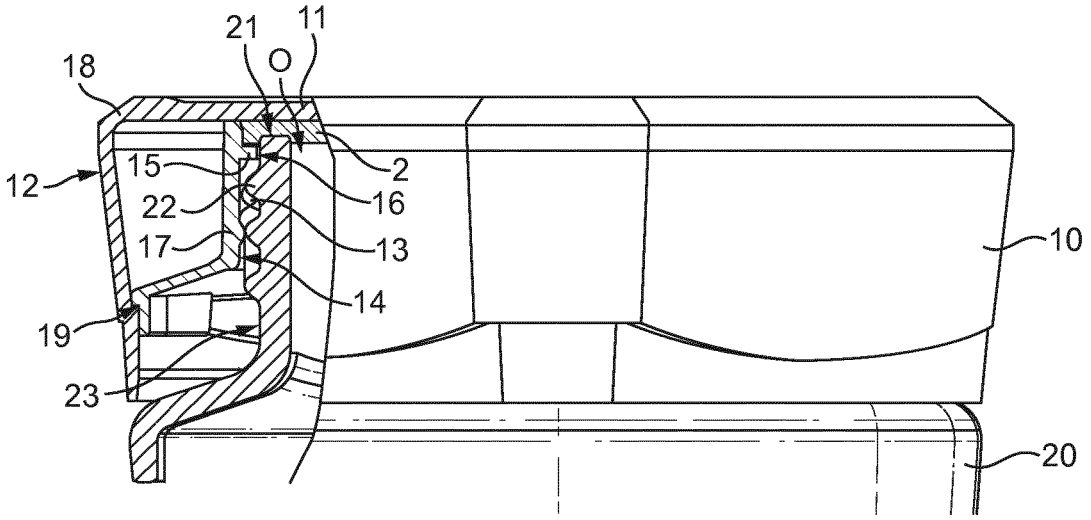
Figure 6A:
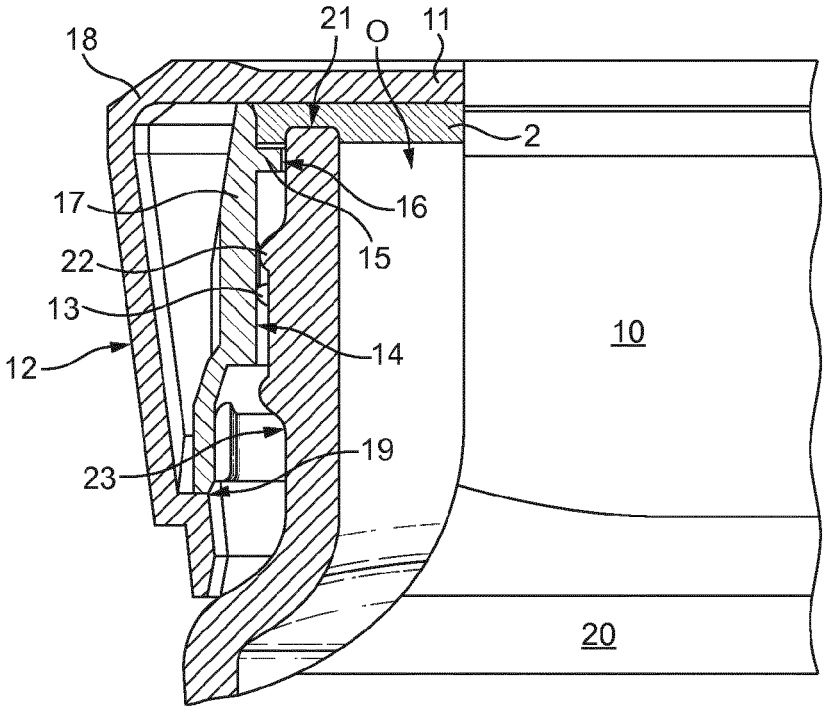
FIG. 6 shows an enlarged view of the partially cut portions of the two embodiments of the receptacle and cap of FIG. 5.
Figure 6B:
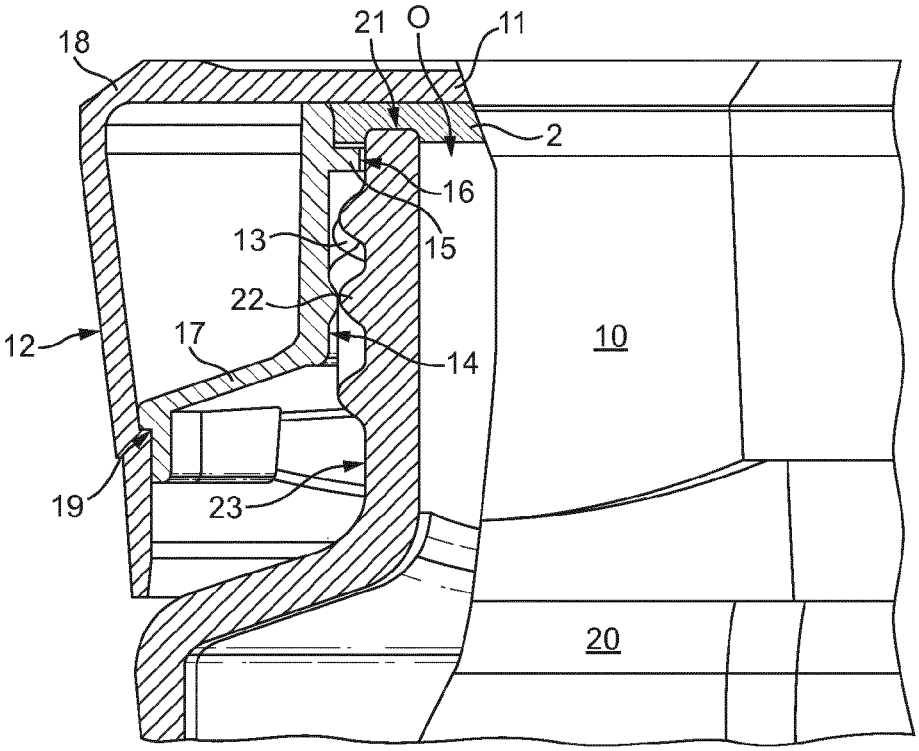

FIGS. 5 and 6 each show two embodiments showing the receptacles 20 as shown in FIG. 3 after the membrane 3 has been removed from the upper rim 21 of the receptacle 20. It can be clearly seen that the backing layer 2 is still retained inside the cap 10 via the retention portion 15. Due to its expanded and foamy structure, the backing layer 20 absorbing the tolerances between the bottom 11 of the cap 10 and the upper rim 21 of the receptacle 20 applies a certain sealing effect from the ambiance, especially against humidity, in the "reclosed" condition of the receptacle 20.

When initially opening the receptacle 20 by removing (e.g. unscrewing or unclipping) the cap 10, a relatively high opening torque or force is required since the membrane 3 being retained inside the cap 10 as can be seen in FIGS. 3 and 4 has to pass the retention portion 15. To reduce this opening torque or force and thus making the opening of the receptacle 20 much more comfortable for the consumer, at least the membrane 3 of the element 1 is contoured as exemplarily shown in FIG. 1. In particular, the sealable element 1 is designed such that at least the membrane 3 has a contour with a radius varying between a lower radius value L and an upper radius value U. The membrane 3 thus preferably has a corrugated or undulated or segmented or stepped or serrated (or another kind of contoured) outer circumference or contour as is shown in all of the embodiments of FIG. 1. The ratio between the lower radius value L and the upper radius value U is defined by the equation $$0.9 \leq L/U \leq 0.99,$$

preferably $0.95 \leq L/U \leq 0.97$.

Preferably, the contour of the membrane 3 alternately changes between the lower radius value L and the upper radius value U, wherein the contour of the membrane 3 preferably has a radius continuously or stepwise or partially continuously and partially stepwise varying between the lower radius value L and the upper radius value U. "Partially continuously and partially stepwise varying radius" means that, for instance, the contour of the membrane is serrated and the radius continuously increases along the circumference of the membrane and, when reaching the maximum (upper) radius value, abruptly decreases until reaching the lowermost (lower) radius value and then again increases and so forth.

Preferably, the varying radii of the membrane 3 about its circumference being greater than (an equal to) an averaged radius of the membrane 3 can be considered as upper radius value U, while the varying radii of the membrane 3 about its circumference being less than (an equal to) the averaged radius of the membrane 3 can be considered as lower radius value L.

Figure 3A:
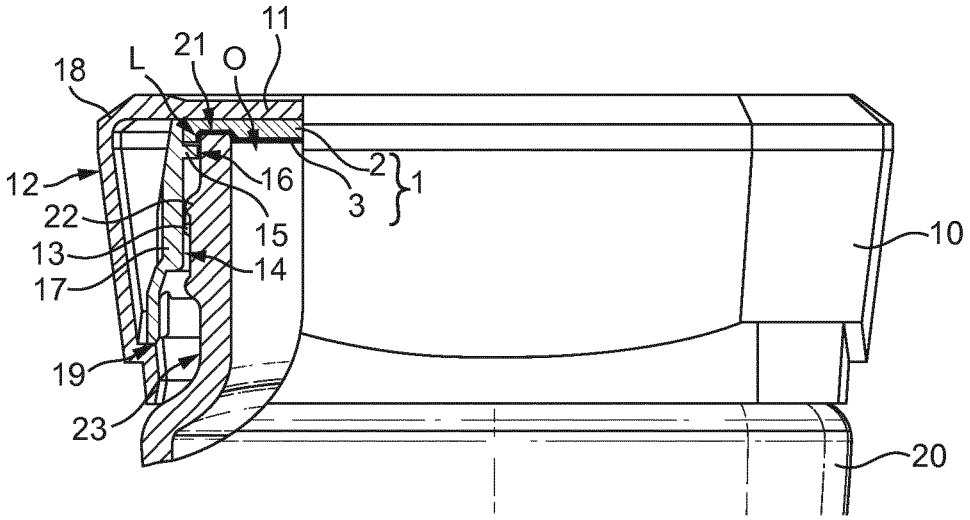
FIG. 3 shows a partially cut side view of an upper portion of two embodiments of a receptacle and a cap having a sealable element according to the invention.
Figure 3B:
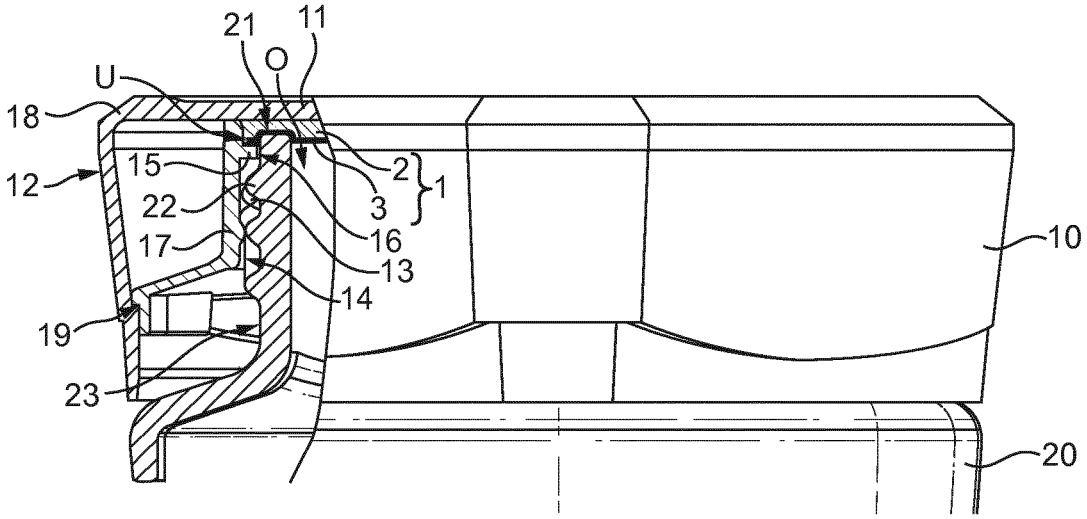
Figure 4A:
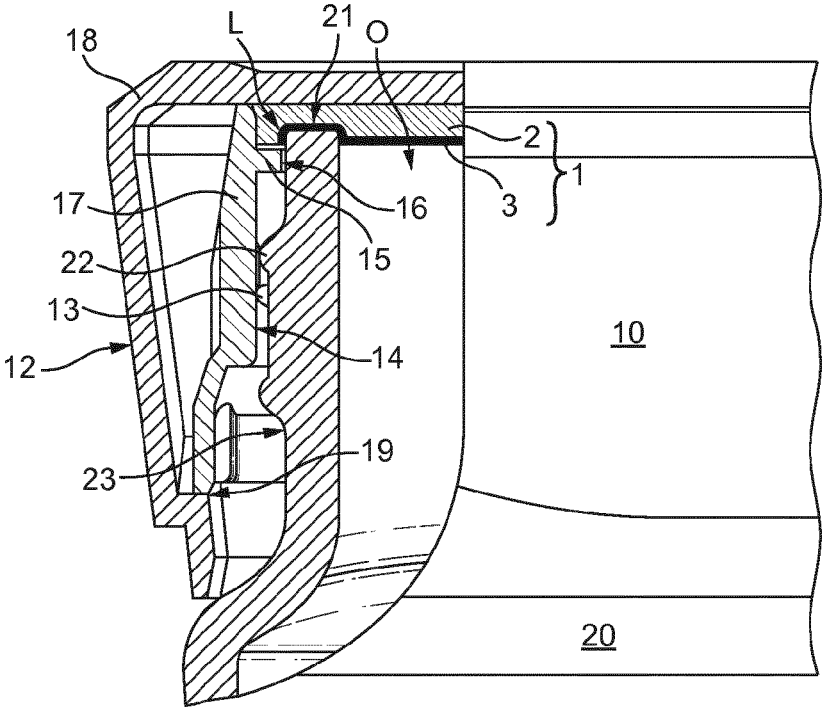
FIG. 4 shows an enlarged view of the partially cut portions of the two embodiments of the receptacle and cap of FIG. 3.
Figure 4B:
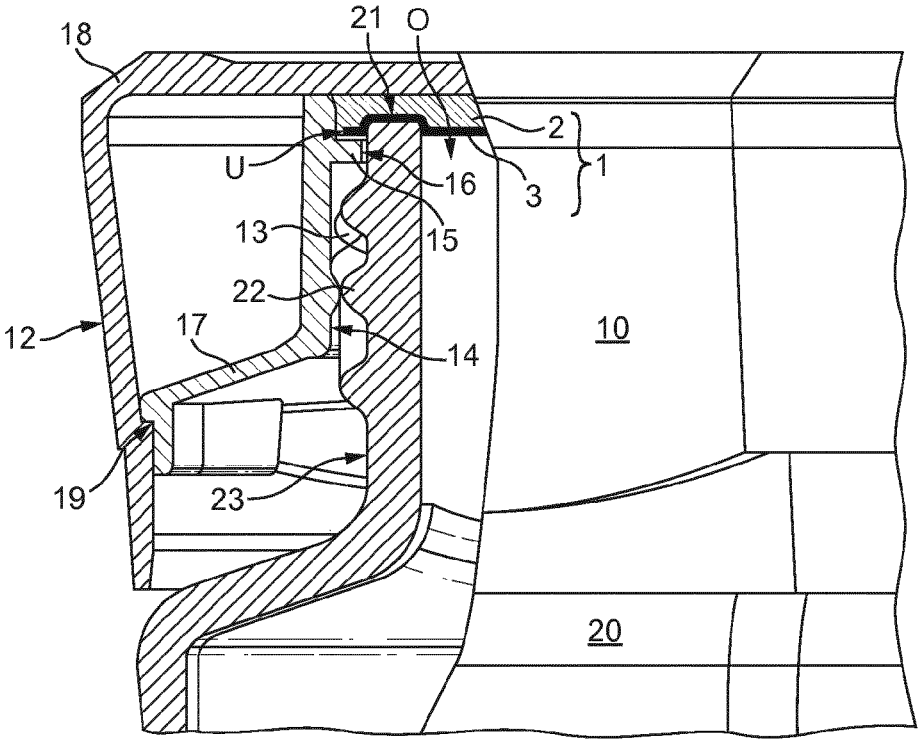

The radius values L, U are also depicted in FIGS. 3 and 4; the partial cut of FIGS. 3*a* and 4*a* has been made in a region of the lower radius value L, while the partial cut of FIGS. 3*b* and 4*b* has been made in a region of the upper radius value U. As can be seen in FIG. 1, the element 1 or membrane 3 and backing layer 2 generally have a substantially circular shape (apart from the radius values L, U) but are not limited thereto; the shape is preferably defined by the shape of the upper rim 21 of the receptacle 20 to be closed by the element 1 or membrane 3.

Hence, an undesired high opening torque or force can be reduced in that an overhanging surface area or portion of the membrane 3 required for initially retaining the membrane 3 in the cap 10 via the retention portion 15 is reduced. For example, a reduction by 50% of the overhanging area of the membrane which interacts with or is engaged by the retention portion 15 leads to a reduction of the opening torque or force of the initial opening of the cap 10 of approximately 25%. It is thus possible to provide a sealable element 1 which can be securely retained in a cap 10 during the mounting of the cap 10 on a receptacle 20 and the sealing of the membrane 3 to the upper rim 21 of the receptacle 20, while an initial opening of the cap 10 is made more comfortable for the user without a degradation in the sealing effect of the cap 10.

In a preferred embodiment, a maximum radius of the membrane 3 in an area in which the contour of the membrane 3 presents the lower radius value L is identical to or smaller than the radius (half of the diameter) of the inner circumferential edge 16 of the retention portion 15. Further, a maximum radius of the membrane 3 in an area in which the contour of the membrane 3 presents the upper radius value U is greater than the radius (half of the diameter) of the inner circumferential edge 16 of the retention portion 15. It is thus possible to effectively reduce the area of the membrane 3 being placed between the retention portion 15 and the bottom 11 of the cap 10 thus reducing the opening torque or force when initially removing the cap 10 from the receptacle 20. Preferably, at least an area of the membrane 3 in which the contour of the membrane 3 presents the upper radius value U radially extends beyond the outer circumference of the upper rim 21 of the receptacle 20 thus providing a portion of the membrane 3 to be retained by the retention portion 15. However, also an area of the membrane 3 in which the contour of the membrane 3 presents the lower radius value L may radially extend beyond the outer circumference of the upper rim 21 of the receptacle 20; however, this overhanging portion preferably not extends beyond the inner circumferential edge 16 of the retention portion 15 as will also be apparent from the examples presented herein.

In a preferred embodiment, the upper radius value portions extend over less than 75% of the total outer circumference of the membrane 3, preferably over less than 50%, more preferably over less than 25%. It goes without saying that the upper and lower radius value U portions do not need to extend over the outer circumference of the membrane 3 at a stretch but the upper and lower radius value portions are preferably alternately provided about and preferably evenly distributed over the circumference of at least the membrane 3.

In FIG. 1, three embodiments of a sealable element 1 or a membrane 3 are shown. In a preferred embodiment, the backing layer 2 has substantially the same outer contour as the membrane 3. In this case, FIG. 1 shows embodiments of a sealable element 1 viewed from the side of the membrane 3. In case the contour of the backing layer 2 differs from the contour of the membrane 3, FIG. 1 merely shows a membrane 3.

Nevertheless, FIG. 1*a* shows an embodiment of the membrane 3, in which the upper radius value U extends over approximately 62% of the overall outer circumference of the membrane 3. In FIG. 1*b*, the upper radius value U extends over approximately 30% of the overall outer circumference of the membrane 3. In FIG. 1*c*, the upper radius value U extends over approximately 58% of the overall outer circumference of the membrane 3. It is understood that the invention is neither limited to the particular contour of the membrane 3 or sealed element 1 nor to the percentage of the circumferential area of the membrane 3 representing either the upper radius value U or the lower radius value L.

In the following, typical dimensions are given exemplarily to better understand the invention. However, these dimensions do not limit the invention to a particular range of dimensions but the invention can be used for any such caps 10 or receptacles 20 as described in the light of this invention.

Example 1

Radius of inner side wall 14 of the cap 10: 24.5-25 mm
Radius of inner circumferential edge 16 of the retention portion 15: 23.5-24 mm
Radial extension of the retention portion 15 from said inner side wall 14 towards the inside of the cap 10: 1-1.25 mm
Outer radius of the upper rim 21: 23-23.5 mm
Minimum radius (r) of the membrane 3 in a lower radius value portion: 23-24 mm
Maximum radius (R) of the membrane 3 in an upper radius value portion: 24-24.75 mm
Overhang of the membrane 3 in a lower radius value portion: 0-0.75 mm
Overhang of the membrane 3 in an upper radius value portion: 1-1.75 mm
Ratio between lower radius value L and upper radius value U: 0.94-0.98

Example 2

Radius of inner side wall 14 of the cap 10: 28.5-29 mm
Radius of inner circumferential edge 16 of the retention portion 15: 27.25-28 mm
Radial extension of the retention portion 15 from said inner side wall 14 towards the inside of the cap 10: 1-1.25 mm
Outer radius of the upper rim 21: 27-27.5 mm
Minimum radius (r) of the membrane 3 in a lower radius value portion: 27-28 mm
Maximum radius (R) of the membrane 3 in an upper radius value portion: 28-28.75 mm
Overhang of the membrane 3 in a lower radius value portion: 0-0.75 mm
Overhang of the membrane 3 in an upper radius value portion: 1-1.75 mm
Ratio between lower radius value L and upper radius value U: 0.94-0.98

Example 3

Radius of inner side wall 14 of the cap 10: 36.75-37.25 mm
Radius of inner circumferential edge 16 of the retention portion 15: 35.5-36.25 mm
Radial extension of the retention portion 15 from said inner side wall 14 towards the inside of the cap 10: 1-1.25 mm
Outer radius of the upper rim 21: 35.25-35.75 mm
Minimum radius (r) of the membrane 3 in a lower radius value portion: 35.25-36.25 mm
Maximum radius (R) of the membrane 3 in an upper radius value portion: 36.25-37 mm Overhang of the membrane 3 in a lower radius value portion: 0-0.75 mm Overhang of the membrane 3 in an upper radius value portion: 1-1.75 mm Ratio between lower radius value L and upper radius value U: 0.94-0.98

It is possible that the width (i.e. radial extension) of the retention portion 15 is independent for a plurality of receptacles 20 of different sizes and thus different cap 10 sizes as can be seen in FIGS. 3 to 6. This comes about since the openings O of different sized receptacles 20 are usually identical. The difference in size can be compensated, e.g. by a different outer body 18 having outer dimensions adapted for the respective receptacle 20 sizes. Thus the absolute dimensions of the radius of the membrane 3 and the backing layer 2, respectively, can be constant over a plurality of different receptacles 20 and cap 10 sizes.

With respect to FIG. 1, the membrane 3 may comprise an additional or integral opening means 4. According to one embodiment, the opening means 4 can be an upper radius value U portion which can be gripped and pulled by the consumer to roll the membrane 3 off the rim 21 of the receptacle 20.

According to another embodiment, the opening means 4 can be an opening lid connected to the membrane 3 or an opening tab 5 connected to the rim portion of the membrane 3. In this case, the opening tab 5 is preferably positioned between the backing layer 2 and the membrane 3 preferably by being bent (see arrow A) from or around the rim portion of the membrane 3 to a centre portion thereof. The opening tab 5 is preferably arranged in an area in which the contour of the membrane 3 presents the upper radius value U such that the membrane 3, when being opened, will be easily rolled off the upper rim 21 of the receptacle 20 and will e.g. not break in a slot-like opening. According to an embodiment of the invention, the only upper radius value portion of the membrane 3 can actually be the connecting portion of the membrane 3 to the opening lid or tab 5 or can form the tab 5.

In FIG. 2 it is shown that the opening means 4 can be integrally formed with the membrane 3 in that particular portions of particular layers of the membrane 3 extend over the intended rim portion thereof. The so formed strip like element (i.e. opening means 4 or tab 5) is then bent (see arrow A) about the rim portion of the membrane 3 to extend from the rim portion of the membrane 3 towards a centre portion thereof (see FIG. 1). Regarding FIG. 2*a*, the opening means 4 is made of an extended portion of the second reinforcing layer 303 which is thus made of a thicker material. In this case, the second reinforcing layer 303 of FIG. 2*a* can also be considered as opening lid having the opening tab 5.

In FIG. 2*b*, the opening means 4 is of an extended portion of a layered structure consisting of the reinforcing layers 302, 303 sandwiching the diffusion barrier layer 301 thus forming a strong opening means 4 though the respective layers are each thinner than the second reinforcing layer 303 of FIG. 2*a*. In this case, the compound of the reinforcing layers 302, 303 and the diffusion barrier layer 301 of FIG. 2*b* can also be considered as opening lid having the opening tab 5.

As the opening means 4 or opening tab 5 is preferably made of or at least comprises portions of the reinforcing layers 302, 303 and is thus integrally formed with the membrane 3, a tearing of said opening means 4 or tab 5 or an undesired opening path (e.g. an undesired slot-like opening) of the membrane 3 can be avoided.

In the following the insertion of the sealable element 1 in the cap 10 the mounting of the cap 10 to the receptacle 20 as well as the removal of the membrane 3 will be described.

The backing layer 2 and the membrane 3 are produced and then detachably connected to form the sealable element 1 (see FIGS. 1 and 2). The cap 10 is also produced e.g. by injection molding. In case the cap base body 12 comprises a plurality of parts, these parts are then assembled.

According to the embodiment, the inner body 17 is inserted in and fixed to the outer body 18 by aid of the assembly structure 19. The element 1 is then inserted in the cap 10, particularly at the bottom 11 thereof such that the element 1, i.e. both the backing layer 2 and the membrane 3 are retained inside the cap 10 via the retention portion 15. Alternatively, the element 1 may be placed on the retention portion 15 of the inner body 17 which is then inserted together with the element 1 in the outer body 18 and fixed thereto via the assembly structure 19. The backing layer 2 faces the bottom 11 of the cap 10; i.e. the membrane 3 is positioned between the backing layer 2 and the retention portion 15. Preferably the backing layer 2 is glued or otherwise fixedly connected or adhered to the bottom 11 of the cap 10.

The receptacle 20 is filled with a nutritional product and then the cap 10 is placed or better removably attached (e.g. screwed or clipped) onto the opening O of the receptacle 20 filled with the nutritional product; preferably, the cap 10 is removably attached onto the opening O of the receptacle 20 via its fixing means 13 preferably having a thread (see FIGS. 3 and 4) or clipping means being engaged with the correspondent fixing means 22 (e.g. thread or clipping means) of the receptacle 20 provided at its outer side wall 23. In any case, the cap 10 is removably attached to the receptacle 20 such that the membrane 3 is in contact with and rests on the upper rim 21 of the receptacle 20. In this state the backing layer 2 presses the membrane 3 against the upper rim 21 of the receptacle 20 as can be seen in FIGS. 3 and 4, thus promoting the sealing effect.

Then, the membrane 3 is sealed to the upper rim 21 of the receptacle 21, preferably via induction heat-sealing or induction welding. In this state the membrane 3 is still connected (or "glued") to the backing layer 2. The induction heat-sealing or welding allows a conducting material (e.g. the aluminum diffusion barrier layer 301 of the membrane) to heat under the effect of an electrical induction sealer, thus causing the softening of a sealing film (e.g. the heat-sealable layer 300 of the membrane 3) on the upper rim 21 of the receptacle 20, which sealing film 300 creates a bond with the upper rim 21 resulting in the receptacle 20 being hermetically sealed.

Alternatively, it is also possible that the membrane 3 is provided with an adhesive (e.g. glue or the like) on a face intended to be attached to the upper rim 21 of the receptacle 20. The adhesive is applied onto the membrane 3 before being attached to the upper rim 21 of the receptacle 20 in a way that the adhesive covered area corresponds to the upper rim 21 surface of the receptacle. Hence, the surface area of the membrane 3 intended to be in contact with the upper rim 21 of the receptacle 20 once the cap 10 is attached to the receptacle 20 is covered with the adhesive. When attaching the cap 10 with the sealing element 1 to the receptacle 20, the membrane 3 is sealably attaching onto the upper rim 21 of the receptacle 20 by means of the adhesive thus hermetically sealing the receptacle 20. When making use of such an adhesive, the step of removably attaching the cap 10 to the receptacle 20 comes along with the step of sealing the membrane 3 to the upper rim 21 of the receptacle 20 which thus occur simultaneously. This comes about since the thickness of the (foamy) backing layer 2 is preferably dimensioned such that it applies a force onto and thus presses the membrane 3 in a direction towards the upper rim 21 of the receptacle 20.

Upon opening of the receptacle 20 for the first time by removing (e.g. unscrewing or unclipping) the cap 10, the backing layer 2 being retained by the retention portion 15 is detached from the membrane 3 which remains sealed on the rim 21 and thus the temporary connection between the membrane 3 and the backing layer 2 gets broken preferably by shearing, which typically creates an audible noise. When detaching the membrane 3 from the backing layer 2, the former needs to pass the retention portion 15. Due to the (continuously and/or stepwise) varying radius of at least the membrane 3 the opening torque or force for doing so can be considerably reduced as the outer circumferential area of the membrane 3 being retained by the retention portion 15 is reduced in comparison to a membrane known from the prior art having a constant radius about its circumference.

Once the cap 10 has been removed, the membrane 3 can be removed as well, e.g. by being rolled off the rim 21 by grasping and pulling at the opening means 4, preferably defined by the overhanging portion of the membrane 3 defined by the upper radius value portions or a similar opening tab 5; i.e. preferably via the opening tab 5 being exposed once the cap 10 has been removed from the receptacle 20 and thus the backing layer 2 is detached from the membrane 3.

When reclosing the receptacle 20 with the cap 10 as shown in FIGS. 5 and 6, i.e. after having opened and/or removed the membrane 3 from the receptacle 20, e.g. by aid of the opening tab 5, a certain sealing effect from the ambiance, especially against humidity, is achieved by the backing layer 2 retained inside the cap 10 via the retention portion 15 as being pressed against the upper rim 21 of the receptacle 20.

The invention is not limited to the embodiments described in this application and all features of the embodiments can be combined in any possible way as long as being covered by the scope of the invention as given by the appended claims.

The invention claimed is:

1. A sealable element configured to seal a rim of a receptacle, the sealable element comprising:

a backing layer made from a deformable material; and a sealable membrane detachably connected to the backing layer, the sealable membrane comprising an additional or integral opening member formed as an opening tab that is connected to a rim portion of the sealable membrane, the sealable membrane having a contour with a radius varying between a lower radius value (L) and an upper radius value (U), a ratio between the lower radius value and the upper radius value defined by $0.9 \leq L/U \leq 0.99$, and the opening tab arranged in an area in which the radius of the contour of the sealable membrane is the upper radius value, a portion of the sealable membrane that radially extends beyond an outer circumference of an upper rim of the receptacle defines an overhanging portion, and the overhanging portion of the lower radius value does not extend beyond an inner circumferential edge of a retention portion of a cap base body of a cap configured to close the receptacle.

2. The sealable element according to claim 1, wherein the radius of the contour of the sealable membrane alternately changes between the lower radius value and the upper radius value.

3. The sealable element according to claim 1, wherein portions of the contour with the upper radius value extend over less than 75% of a total outer circumference of the sealable membrane.

4. The sealable element according to claim 1, wherein the backing layer has substantially the same outer contour as the sealable membrane.

5. The sealable element according to claim 1, wherein the backing layer is made from foaming materials.

6. The sealable element according to claim 1, wherein the sealable membrane comprises a diffusion barrier layer.

7. The sealable element according to claim 1, wherein the sealable membrane is made of a stiff material compound and comprises a heat-sealable layer.

8. A sealable element configured to seal a rim of a receptacle, the sealable element comprising:

a backing layer made from a deformable material;

a sealable membrane detachably connected to the backing layer, the sealable membrane having a contour with a radius varying between a lower radius value (L) and an upper radius value (U), a ratio between the lower radius value and the upper radius value defined by $0.9 \leq L/U \leq 0.99$; and an opening tab connected to a rim portion of the sealable membrane and positioned between the backing layer and the sealable membrane, the opening tab arranged in an area in which the radius of the contour of the sealable membrane is the upper radius value, a portion of the sealable membrane that radially extends beyond an outer circumference of an upper rim of the receptacle defines an overhanging portion, and the overhanging portion of the lower radius value does not extend beyond an inner circumferential edge of a retention portion of a cap base body of a cap configured to close the receptacle.

9. A cap for closing a receptacle, the cap comprising:

a cap base body with a fixing member configured to enable the cap to be removably attached on the receptacle; and a sealable element configured to seal a rim of the receptacle, the sealable element comprising a backing layer made from a deformable material and a sealable membrane detachably connected to the backing layer, the sealable membrane comprising an additional or integral opening member formed as an opening tab that is connected to a rim portion of the sealable membrane, the sealable membrane having a contour with a radius varying between a lower radius value (L) and an upper radius value (U), a ratio between the lower radius value and the upper radius value defined by $0.9 \leq L/U \leq 0.99$, the opening tab arranged in a first area in which the radius of the contour of the sealable membrane is the upper radius value, and the sealable element retained inside the cap by a retention portion of the cap base body, a portion of the sealable membrane that radially extends beyond an outer circumference of an upper rim of the receptacle defines an overhanging portion, and the overhanging portion of the lower radius value does not extend beyond an inner circumferential edge of the retention portion.

10. The cap according to claim 9, wherein the retention portion radially extends from an inner side wall of the cap base body of the cap.

11. The cap according to claim 9, wherein a first maximum radius of the sealable membrane in the first area in which the radius of the contour of the sealable membrane is the upper radius value is greater than a radius of an inner circumferential edge of the retention portion, and a second maximum radius of the sealable membrane in a second area in which the radius of the contour of the sealable membrane is the lower radius value is identical to or smaller than the radius of the inner circumferential edge of the retention portion.

12. A receptacle comprising:

a cap for closing a receptacle, the cap comprising a cap base body with a fixing member configured to enable the cap to be removably attached on the receptacle; and a sealable element configured to seal a rim of the receptacle, the sealable element comprising a backing layer made from a deformable material and a sealable membrane detachably connected to the backing layer, the sealable membrane comprising an additional or integral opening member formed as an opening tab that is connected to a rim portion of the sealable membrane, the sealable membrane having a contour with a radius varying between a lower radius value (L) and an upper radius value (U), a ratio between the lower radius value and the upper radius value defined by $0.9 \leq L/U \leq 0.99$, the opening tab arranged in an area in which the radius of the contour of the sealable membrane is the upper radius value, and the sealable element retained inside the cap by a retention portion of the cap base body, the cap is removably attached onto an opening of the receptacle by a fixing member of the cap engaged with a correspondent fixing member of the receptacle provided at an outer side wall of the receptacle such that the sealable membrane rests on and is sealed to an upper rim of the receptacle enclosing the opening, the sealable membrane is pressed towards the upper rim by the backing layer, a portion of the sealable membrane that radially extends beyond an outer circumference of the upper rim of the receptacle defines an overhanging portion, and the overhanging portion of the lower radius value does not extend beyond an inner circumferential edge of the retention portion.

13. The receptacle according to claim 12, wherein at least the area of the sealable membrane in which the radius of the contour of the membrane is the upper radius value radially extends beyond an outer circumference of the upper rim of the receptacle.

* * * * *